US005305871A

United States Patent [19]

Scherer

[11] Patent Number: 5,305,871

[45] Date of Patent: Apr. 26, 1994

[54] PACKAGE-CONVEYING APPARATUS COMPRISING ENDLESS MEMBER CONVEYOR AND PUSHERS

[75] Inventor: Philip G. Scherer, Fort Lauderdale, Fla.

[73] Assignee: Illinois Tool Works Inc., Glenview, Ill.

[21] Appl. No.: 57,149

[22] Filed: May 5, 1993

[51] Int. Cl.[5] ..... B65G 25/00

[52] U.S. Cl. ..... 198/737; 198/717; 198/468.9

[58] Field of Search ..... 198/468.01, 468.9, 468.11, 198/717, 737, 746, 747

[56] References Cited

U.S. PATENT DOCUMENTS

| | | | |
|---|---|---|---|
| 2,191,743 | 2/1940 | Scott | 198/737 |
| 2,461,375 | 2/1949 | Eftihios | 198/737 X |
| 2,864,303 | 12/1958 | Brown et al. | 100/27 |
| 3,191,919 | 6/1965 | Acker | 198/746 X |
| 3,696,944 | 10/1972 | Campbell | 198/746 X |
| 4,110,957 | 9/1978 | Lancaster et al. | 53/589 |
| 4,178,734 | 12/1979 | Lancaster et al. | 53/399 |
| 4,317,322 | 3/1982 | Lancaster et al. | 53/399 |
| 4,563,857 | 1/1986 | Bergling et al. | 53/399 |
| 5,027,581 | 7/1991 | Kovacs | 53/399 |

*Primary Examiner*—James R. Bidwell

*Attorney, Agent, or Firm*—Schwartz & Weinrieb

[57] ABSTRACT

A package-conveying apparatus, which is useful with a wrapping-machine of a type capable of wrapping a package with stretch film from a roll moving in an annular path, comprises an elongate table with two front ledges, a pair of endless belts for conveying a package toward the ledges, and a pair of package pushers. Each pusher includes a leg with a pivotable foot, a double-acting piston-cylinder mechanism for driving the leg frontwardly and backwardly, and a double-acting piston-cylinder mechanism for pivoting the foot upwardly into an operative position and downwardly into an inoperative position. In the operative position, the foot can engage a package to enable the leg when driven frontwardly to push the package from the endless belts onto and from the ledges. In the inoperative position, the foot clears a package on the endless belts when the leg is driven backwardly.

10 Claims, 3 Drawing Sheets

PACKAGE-CONVEYING APPARATUS COMPRISING ENDLESS MEMBER CONVEYOR AND PUSHERS

TECHNICAL FIELD OF THE INVENTION

This invention pertains to a package-conveying apparatus useful with a wrapping machine of a type capable of wrapping a package with stretch film from a roll moving in an annular path. The apparatus comprises an elongate table, a package conveyor including at least one endless member, such as an endless belt, and a pair of package pushers, in a novel combination operable in a novel manner.

BACKGROUND OF THE INVENTION

In a wrapping machine of the type noted above, a roll of stretch film is driven around a ring structure defining an annular path so that stretch film from the roll is wrapped around a package. If the package is a relatively short package, such as a carton not substantially longer than the wrapping machine, it is known to wrap the package while the package is resting on a support, such as a bed of rollers within the ring structure. If the package is a relatively long package, such as one or more pieces of lumber, pipe, or tubing or a roll of textile or carpeting, it is known to wrap the package in a spiral pattern as the package is being conveyed through the wrapping machine, as by an input conveyor, a bed of rollers within the wrapping machine, and an output conveyor.

As exemplified by Model MSB Mima TM Stretch Bundlers, wrapping machines of the type noted above are available commercially from ITW Mima (a unit of Illinois Tool Works Inc.) of Boca Raton, Fla. Machines of related interest are disclosed in prior patents including Brown et al. U.S. Pat. No. 2,864,303, Lancaster et al. U.S. Pat. No. 4,110,957, Lancaster et al. U.S. Pat. No. 4,178,734, Lancaster et al. U.S. Pat. No. 4,317,322, Bergling et al. U.S. Pat. No. 4,563,857, and Kovacs U.S. Pat. No. 5,027,581.

There has been a need, to which this invention is addressed, for a package-conveying apparatus useful with a packaging machine of the type noted above and capable of conveying a relatively short package, such as a carton not substantially longer than the wrapping machine, into the wrapping machine before the package is wrapped and from the wrapping machine after the package has been wrapped.

SUMMARY OF THE INVENTION

This invention provides a package-conveying apparatus meeting the need noted above. Broadly, the package-conveying apparatus comprises an elongate table, a package conveyor including at least one endless member, such as an endless belt, and a pair of package pushers, in a novel combination operable in a novel manner.

The elongate table has a back end and a front end. At least one elongate ledge is mounted to the elongate table so as to extend frontwardly from the front end. A front end of the at least one elongate ledge is spaced frontwardly from the front end of the table. Preferably, two such ledges extend similarly therefrom, in side-to-side relation to each other.

The package conveyor is mounted operatively to the elongate table and includes at least one endless member, which is adapted to receive a package thereon, near the back end of the elongate table. Preferably, a pair of endless belts extend along the elongate table in side-by-side relation to each other, each having an upper run overlying the elongate table and a lower run underlying the elongate table. The package conveyor further includes means for driving the at least one endless member so as to convey a package on the at least one endless member frontwardly toward the front end of the elongate table.

The package pushers are mounted operatively to the elongate table in side-to-side relation to each other. Each package pusher includes a longitudinally extending leg with a front end. Each package pusher also includes means for driving the leg frontwardly from a retracted position, through an intermediate position, to an extended position and for driving the leg backwardly from the extended position, through the intermediate position, to the retracted position. In the retracted position, the front end of the leg is spaced backwardly from the front end of the elongate table. In the intermediate position, the front end of the leg is near the front end of the elongate table. In the extended position, the front end of the leg of such package pusher is near the front end of the at least one elongate ledge. Preferably, the means for driving the leg of each package pusher includes a double-acting piston-cylinder mechanism, which is connected operatively between the elongate table and the leg of such package pusher.

The package pushers are operable in such manner that the leg of one such pusher is driven frontwardly as the leg of the other pusher is driven backwardly. Thus, the leg of whichever of the package pushers is driven frontwardly at any given time is capable of pushing a package from the at least one endless member onto the at least one elongate ledge, as the same leg is driven from the retracted position to the intermediate position. Also, the leg of whichever of the package pushers is driven frontwardly at any given time is capable of pushing a package from the at least one elongate ledge, as the same leg is driven from the intermediate position to the extended position.

Preferably, a foot is mounted to the leg of each package pusher so as to be selectively movable between an operative position wherein the foot is capable of engaging a package on the at least one endless member so as to enable the leg of such package pusher to push the package as the leg of such package pusher is driven frontwardly and an inoperative position wherein the foot is disposed so as to clear a package thereon as the leg of such package pusher is driven backwardly. The foot may be upwardly pivotable to the operative position and downwardly pivotable to the inoperative position. Preferably, each package pusher includes means for pivoting the foot mounted to the leg of such package pusher selectively between the operative and inoperative positions, such as a double-acting piston-cylinder mechanism connected operatively between the leg of such package pusher and the foot mounted thereto.

These and other objects, features, and advantages of this invention are evident from the following description of a preferred embodiment of this invention with reference to the accompanying drawings.

BRIEF DESCRIPTION OF THE DRAWINGS

FIG. 3 is more detailed.

FIG. 4 is more detailed.

DETAILED DESCRIPTION OF PREFERRED EMBODIMENT

Figure 1:
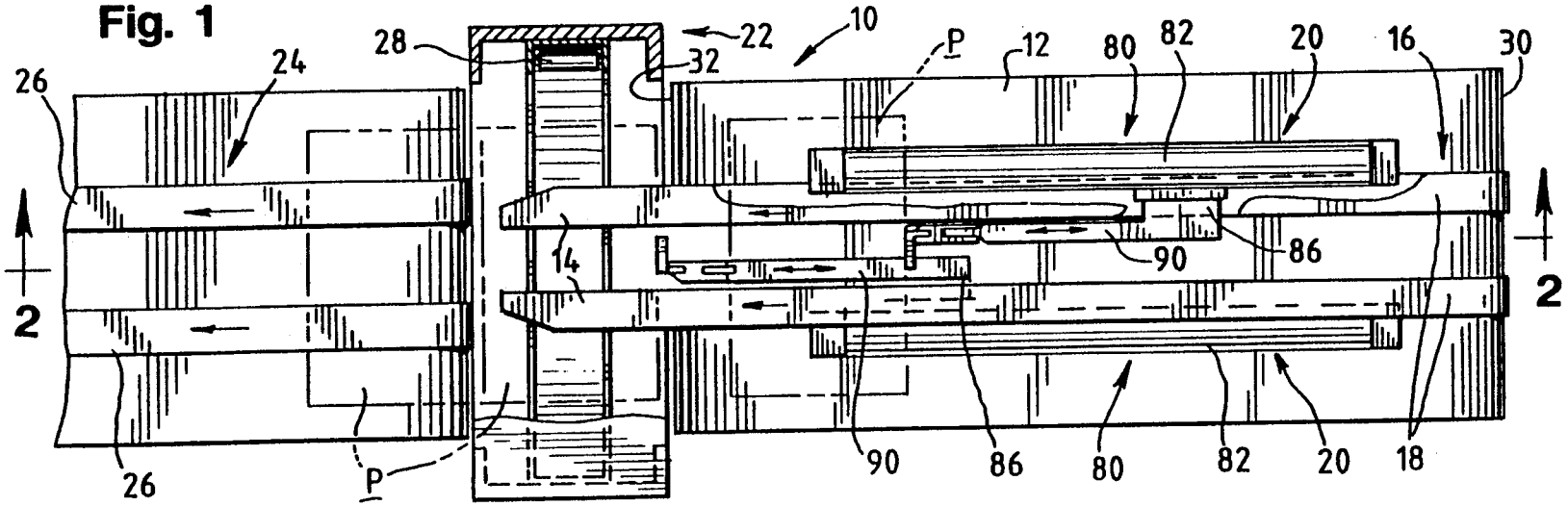
FIG. 1 is a schematic, upper plan view of a package-conveying apparatus according to this invention, as used with a wrapping machine of the type noted above and with an outfeed conveyer.

As shown in the drawings, a package-conveying apparatus 10 constitutes a preferred embodiment of this invention. Broadly, the apparatus 10 comprises an elongate table 12, a pair of elongate ledges 14 extending frontwardly from the table 12, a package conveyor 16 including a pair of endless belts 18 extending along the table 12 in side-by-side relation to each other, and a pair of package pushers 20, in a novel combination operable in a novel manner.

As shown in the drawings, the apparatus 10 is used with a wrapping machine 22 of the type noted above, such as a Model MSB Mima TM Stretch Bundler discussed above without a bed of rollers, and with an outfeed conveyor 24 of a known type comprising two endless belts 26. The apparatus 10 may be also used with an infeed conveyor (not shown) similar to the outfeed conveyor 24.

Figure 2:
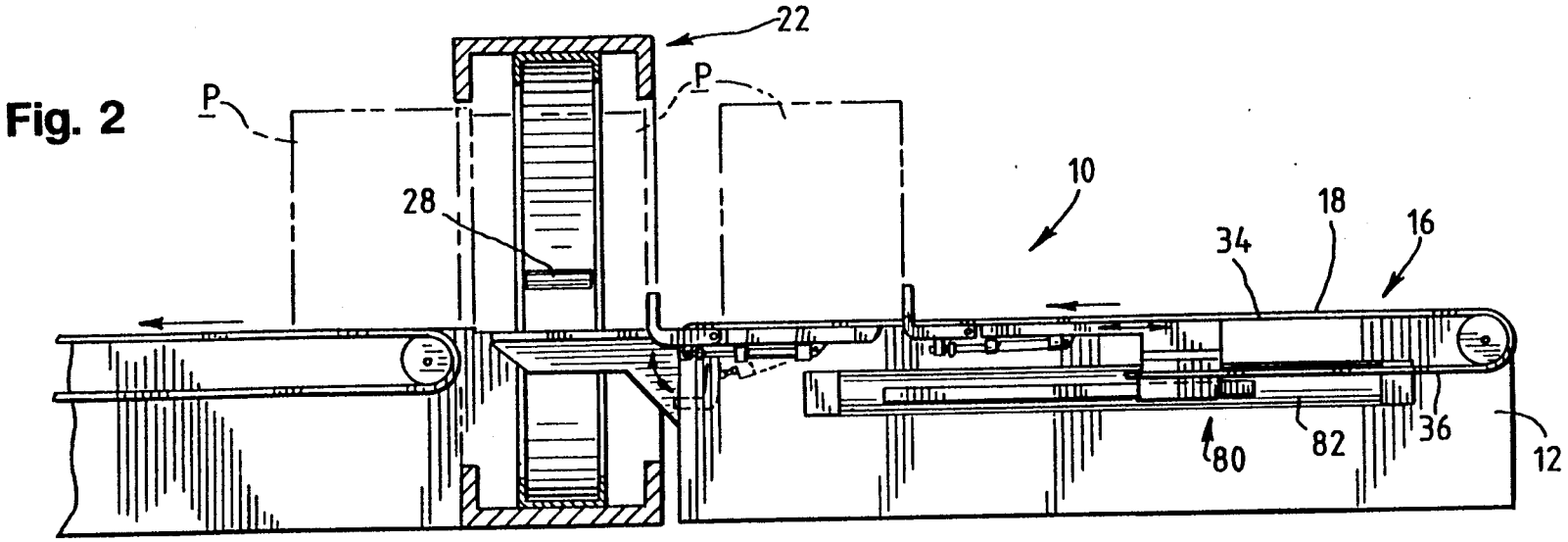
FIG. 2 is a schematic, side elevation of the package-conveying apparatus, as used with the wrapping machine and the outfeed conveyor.

As shown in FIGS. 1 and 2, the apparatus 10 is positioned behind the wrapping machine 22 so that the ledges 14 extend frontwardly into the wrapping machine 22, so as to replace the bed of rollers noted above. Being of the type noted above, the wrapping machine 22 is capable of wrapping a package, such as the package P shown in broken lines in FIGS. 1 and 2, with stretch film from a roll 28 moving in an annular path, after the package has been moved onto the elongate ledges 14 extending into the wrapping machine 22. Since the elongate ledges 14 are wrapped along with the package, it becomes necessary to strip the film from the elongate ledges 14, in a manner to be later described. Details of the wrapping machine 22 and details of the outfeed conveyor 24 are outside the scope of this invention and can be readily supplied by persons having ordinary skill in the art.

Each of the endless belts 18 has an upper run 34 overlying the table 12 and a lower run 36 underlying the table 12. After a package has been placed, admitted, or conveyed onto the upper runs 34 of the endless belts 18, near a back end 30 of the table 12, the package conveyor 16 is used to convey the package, via the upper runs 34 of the endless belts 18, from a back end 30 of the table 12 to a front end 32 of the table 12. Next, one of the package pushers 20 is used to push the package from the upper runs 34 of the endless belts 18 onto the ledges 14, before the package is wrapped with such film. Next, the same pusher 20 is used to push the package from the ledges 14 onto the endless belts 26 of the outfeed conveyor 24, after the package has been wrapped with such film.

The table 12 supports two subassemblies 40 in side-by-side relation to each other. Each subassembly 40 includes one of the elongate ledges 14, one of the endless belts 18, and one of the package pushers 20. Each subassembly further includes an electric motor 42 arranged to drive the endless belt 18 of such subassembly 40 via a chain drive 44, a package sensor 46 near the back end 30 of the table 12, a package sensor 48 near the front end 32 of the table 12, and a guide rail 50. One of the guide rails 50 is shown fragmentarily in FIG. 4. The package sensors 46, 48, are mechanical sensors of a known type.

Figure 3:
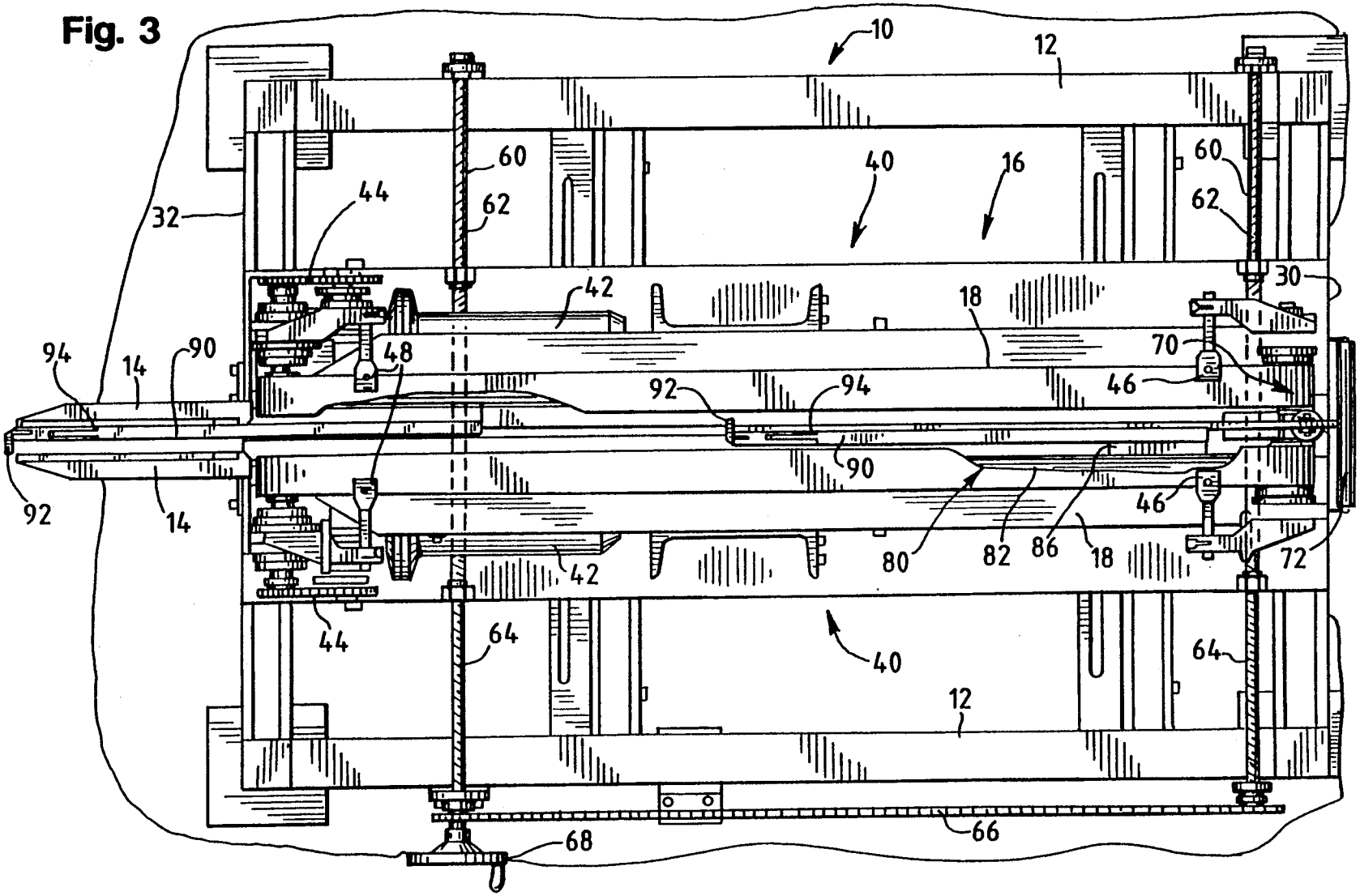
FIG. 3 is a fragmentary, upper plan of the package-conveying apparatus. As compared to FIG. 1.

As shown in FIG. 3, the subassemblies 40 are mounted to the table 12 via two worm screws 60, one nearer the back end 30 and another near the front end 32. Each worm screw 60 has a portion 62 with a right-hand thread and a portion 64 with a left-hand thread, as viewed from one side of the apparatus 10, namely the side shown in FIG. 4. The portions 62 with right-hand threads are on the same side of the apparatus 10 and mount one such subassembly 40. The portions 64 with left-hand threads are on the other side of the apparatus 10 and mount the other subassembly 40. The worm screws 62 are interconnected via a chain and sprocket drive 66, on one side of the apparatus 10, so as to be conjointly rotatable in either rotatable sense. A hand crank 68 is connected to the worm screw 60 near the front end 32 of the table 12. The hand crank 68 enables the worm screws 60 to be manually rotated so as to adjust the subassemblies 40 transversely toward and away from each other so as to accommodate packages of various widths.

At the back end 30, the table 12 has a gate assembly 70, which is operable to admit only one package at any one time onto the package conveyor 16 from an infeed conveyor (not shown) similar to the outfeed conveyor 24 and located behind the apparatus 10. The gate assembly 70 comprises a transverse roller 72 and a small, double-acting, pneumatic, piston-cylinder mechanism 74 connected operatively between the table 12 and the roller 72. The mechanism 74 is operative to raise the roller 72 to an elevated position above the endless belts 18 when it is desired to block a package being conveyed by the infeed conveyor and to lower the roller 72 to a lowered position below the endless belts 18 when it is desired to admit a package onto the package conveyor 16 from the infeed conveyor. The roller 72 is shown in the lowered position in FIG. 4.

Each package pusher 20 includes a large, double-acting, pneumatic, piston-cylinder mechanism 80 extending longitudinally for a substantial distance between the table ends 30, 32, as shown schematically in FIGS. 1 and 2. The mechanism 80 comprises an external cylinder 82 mounted fixedly to the elongate table 12 and an internal piston (not shown) arranged to drive an external slider 86 frontwardly and backwardly along the cylinder 82.

Figure 4:
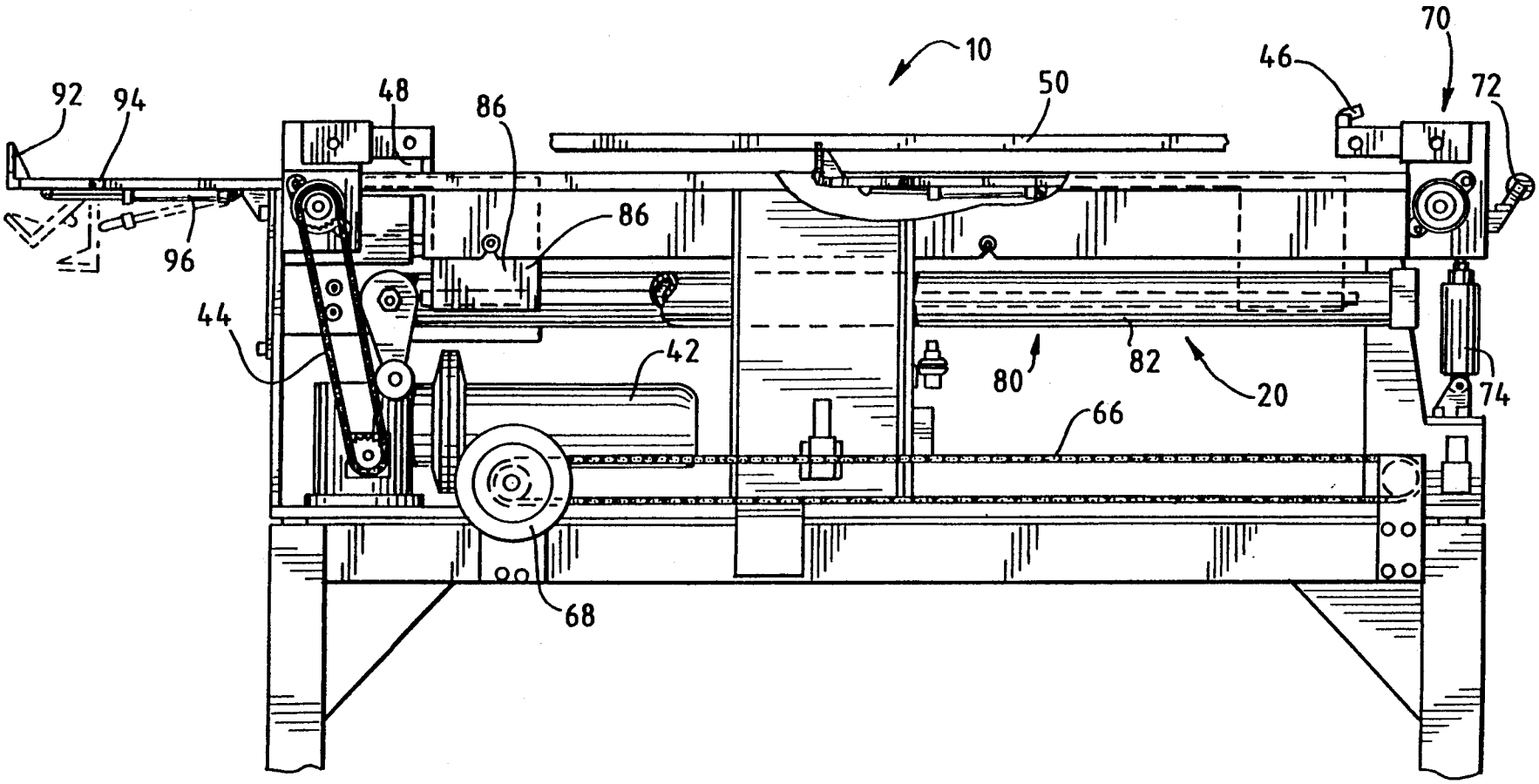
FIG. 4 is a fragmentary, side elevation of the package-conveying apparatus. As compared to FIG. 2.

Each package pusher 20 includes a longitudinally extending leg 90, which is mounted to the slider 86 of the piston-cylinder mechanism 80 of such package pusher 20 for conjoint movement with the slider 86 thereof, a foot 92, which is mounted to a front end 94 of the leg 90 so as to be upwardly movable between an operative position and an inoperative position, and a small, double-acting, pneumatic, piston-cylinder mechanism 96, which is connected operatively between the leg 90 and the foot 92. The piston-cylinder mechanism 80 of each package pusher 20 is arranged to drive the leg 90 thereof and the foot 92 thereof frontwardly and backwardly. One of the piston-cylinder mechanisms 96 is shown in FIG. 4. The piston-cylinder mechanism 96 of each package pusher 20 is operative to pivot the foot 92 thereof upwardly to the operative position and downwardly to the inoperative position.

In the operative position, in which one foot 92 and the piston-cylinder mechanism 96 operative to pivot the foot 92 are shown in solid lines in FIG. 4, the foot 92 of each package pusher 20 is capable of engaging a package on the upper runs 34 of the endless belts 18 so as to enable the leg 90 of such package pusher 20 to push the package as the leg 90 of such package pusher 20 is driven frontwardly. In the inoperative position, in which one foot 92 and the piston-cylinder mechanism 96 operative to pivot the foot 92 are shown in broken lines in FIG. 4, the foot 92 of each package pusher 20 is disposed so as to clear a package on the upper runs 34 of the endless belts 18 as the leg 90 of such package pusher 20 is driven backwardly.

The package pushers 20 are operable in such manner that the leg 90 of one such pusher 20 is driven frontwardly as the leg 90 of the other pusher 20 is driven backwardly, that the foot 92 of the leg 90 driven frontwardly is pivoted upwardly to the operative position described above, and that the foot 92 of the leg 90 driven backwardly is pivoted downwardly to the inoperative position described above. Thus, the leg 90 driven frontwardly at any one time is capable of pushing a package from the upper runs 34 of the endless belts 18 onto the elongate ledges 14 as the leg 90 driven frontwardly is driven from the retracted position described above to the intermediate position described above, via the foot 92 on the leg 90 driven frontwardly. Also, the leg 90 driven frontwardly at any one time is capable of pushing a package from the elongate ledges 14 onto the outfeed conveyor 24 as the leg 90 driven frontwardly is driven from the intermediate position described above to the extended position described above, because the foot 92 on the leg 90 driven frontwardly is capable of engaging the package, via the foot 92 on the leg 90 driven frontwardly.

While the package remains on the elongate ledges 14, the package and such ledges 14 are wrapped with stretch film from the roll 28. Thereupon, the wrapped package is pushed from the elongate ledges 14, as described above. As the package is pushed from the elongate ledges 14, stretch film wrapping the package and such ledges 14 is stripped from such ledges 14.

Various modifications may be made in the preferred embodiment described above without departing from the scope and spirit of this invention.

I claim:

1. A package-conveying apparatus useful with a wrapping machine of a type capable of wrapping a package with stretch film from a roll moving in an annular path, the package-conveying apparatus comprising (a) an elongate table having a back end and a front end, at least one elongate ledge mounted to the elongate table so as to extend frontwardly from the front end, the at least one elongate ledge having a front end spaced frontwardly from the front end of the table, (b) a package conveyor mounted operatively to the elongate table and including at least one endless member adapted to receive a package on the at least one endless member, near the back end of the elongate table, the package conveyor including means for driving the at least one endless member so as to convey a package thereon frontwardly toward the front end of the elongate table, (c) a pair of package pushers mounted operatively to the elongate table in side-to-side relation to each other, each package pusher including a longitudinally extending leg with a front end and means for driving the leg frontwardly from a retracted position wherein the front end of the leg is spaced backwardly from the output end of the elongate table, through an intermediate position wherein the front end of the leg is near the output end of the elongate table, to an extended position wherein the front end of the leg is near the front end of the at least one elongate ledge and for driving the leg backwardly from the extended position, through the intermediate position, to the retracted position, the package pushers being operable in such manner that the leg of one such pusher is driven frontwardly as the leg of the other pusher is driven backwardly and that the leg of whichever of the package pushers is driven frontwardly at any given time is capable of pushing a package from the at least one endless member onto the at least one elongate ledge as the leg being driven frontwardly is driven from the retracted position to the intermediate position and of pushing a package from the at least one elongate ledge as the leg being driven frontwardly is driven from the intermediate position to the extended position.

2. The package-conveying apparatus of claim 1 wherein the means for driving the leg of each package pusher includes a double-acting piston-cylinder mechanism connected operatively between the elongate table and the leg of such package pusher.

3. The package-conveying apparatus of claim 1 wherein a foot is mounted to the leg of each package pusher so as to be selectively movable between an operative position wherein the foot is capable of engaging a package on the at least one endless member so as to enable the leg of such package pusher to push the package as the leg of such package pusher is driven frontwardly and an inoperative position wherein the foot is disposed so as to clear a package on the at least one endless member as the leg of such package pusher is driven backwardly.

4. The package-conveying apparatus of claim 3 wherein the foot is mounted so as to be selectively pivotable between the operative and inoperative positions.

5. The package-conveying apparatus of claim 4 wherein the foot is mounted so as to be selectively pivotable upwardly to the operative position and downwardly to the inoperative position.

6. The package-conveying apparatus of claim 5 wherein each package pusher includes means for pivoting the foot mounted to the leg of such package pusher selectively between the operative and inoperative positions.

7. The package-conveying apparatus of claim 6 wherein the foot-pivoting means of each package pusher includes a double-acting piston-cylinder mechanism connected operatively between the leg of such package pusher and the foot mounted thereto.

8. The package-conveying apparatus of claim 1 wherein the at least one elongate ledge includes a pair of elongate ledges mounted to the elongate table in side-by-side relation to each other so as to extend frontwardly from the output end.

9. The package-conveying apparatus of claim 1 wherein the at least one endless member includes at least one endless belt extending along the elongate table, the at least one belt having an upper run overlying the elongate table and a lower run underlying the elongate table.

10. The package-conveying apparatus of claim 1 wherein the at least one endless member includes a pair of endless belts extending along the elongate table in side-by-side relation to each other, each endless belt having an upper run overlying the elongate table and a lower run underlying the elongate table.

* * * * *